United States Patent [19]

Hoaglin

[11] Patent Number: 5,038,649

[45] Date of Patent: Aug. 13, 1991

[54] FOOD SLICER ADAPTER

[76] Inventor: Robert J. Hoaglin, 13024 SE. 237th Ct., Kent, Wash. 98031

[21] Appl. No.: 396,303

[22] Filed: Aug. 21, 1989

[51] Int. Cl.[5] ..... B26D 7/06

[52] U.S. Cl. ..... 83/440; 83/932; 241/37.5; 241/291

[58] Field of Search ..... 83/402, 856–858, 83/440, 932; 241/92, 282.1, 282.2, 37.5, 291

[56] References Cited

U.S. PATENT DOCUMENTS

| | | | |
|---|---|---|---|
| 4,397,427 | 8/1983 | Howard | 241/282.1 X |
| 4,512,522 | 4/1985 | Williams | 241/37.5 |
| 4,544,103 | 10/1985 | Breeden | 241/37.5 |
| 4,623,097 | 11/1986 | Southeimer | 241/37.5 |
| 4,691,870 | 9/1987 | Fukunaga et al. | 241/37.5 X |

*Primary Examiner*—Timothy V. Eley
*Attorney, Agent, or Firm*—Leon Gilden

[57] ABSTRACT

A food slicer adapter is provided for securement in combination with a food slicer containing an underlying hopper with relatively movable blades mounted therewithin. The adapter is provided for sliding interengagement with one of a plurality of feed hoppers contained within the food slicer and contains a central feed tube formed with a feed opening overlying a transparent shield. The shield overlies a plurality of diametrically opposed spacer flanges defining a diameter essentially equal to that of an internal diameter defined by the feed hopper. The flanges are formed with leg members with a slot defined within the leg members and the flanges for interfitting within diametrically opposed slots within the feed hopper. A ram directs food positioned within the feed opening and directs such food past diametrically positioned and orthogonally oriented blades secured at a lowermost end of the adapter.

8 Claims, 4 Drawing Sheets

10
17
18
19
20
20
25
26
16
16
15

17
18

24
19
24
22
22
23
22a
22a
23
21
25
26
27
28
a
a

FIG 4
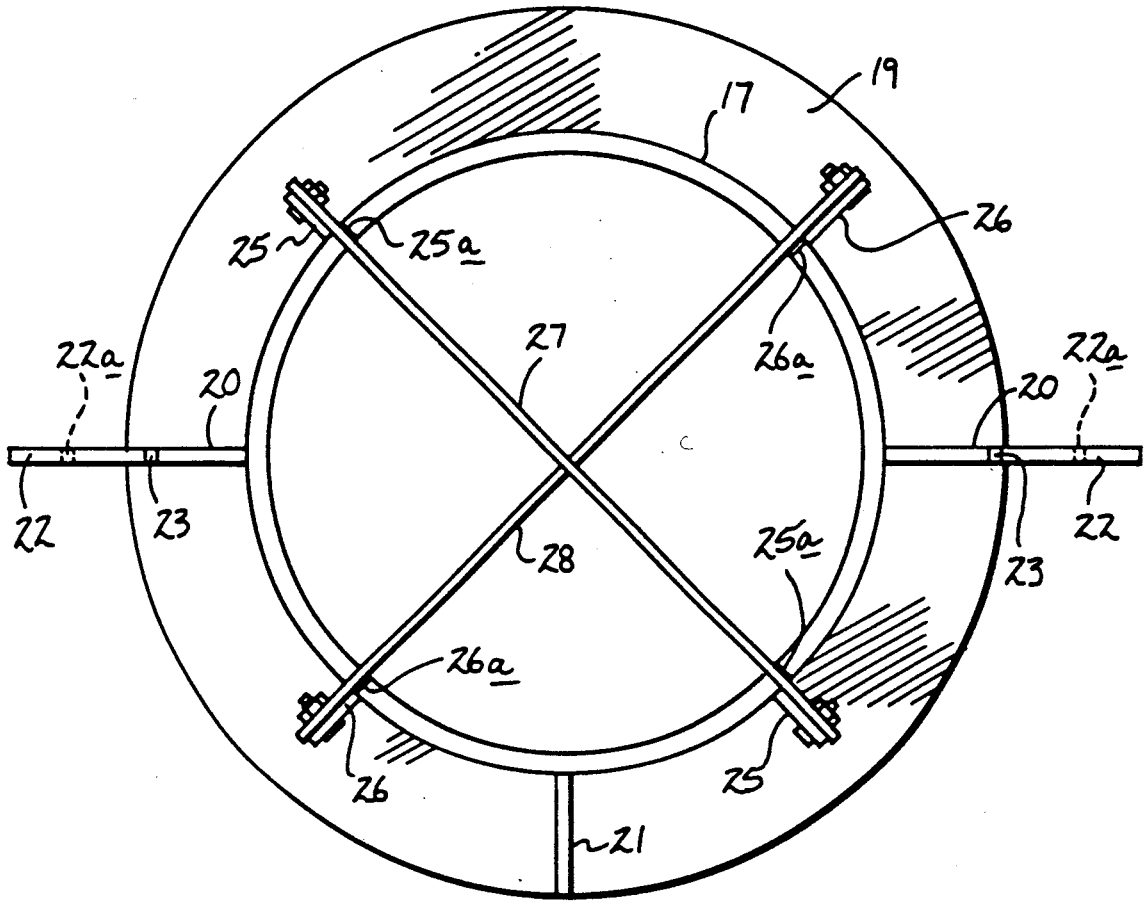
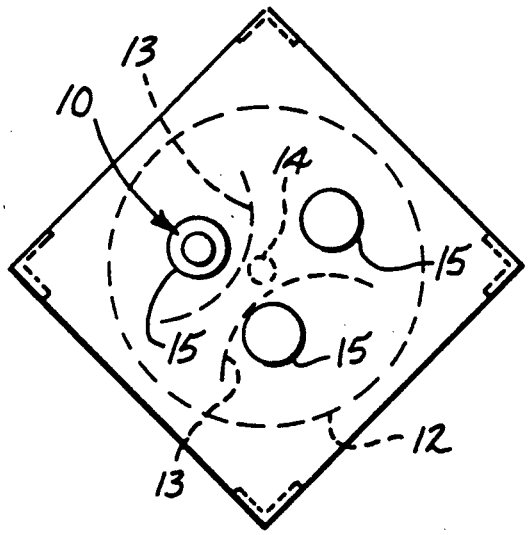
FIG 1A
PRIOR ART

FOOD SLICER ADAPTER

BACKGROUND OF THE INVENTION

1. Field of the Invention

The field of invention relates to food slicing, and more particularly pertains to a new and improved food slicer adapter arranged to interfit within a feed hopper to diametrically reduce a feed diameter to accommodate foods of smaller cross-sectional areas, such as peppers and the like.

2. Description of the Prior Art

The use of food slicers of various types is well known in the prior art. Particularly in the slicing of various vegetables, such as lettuce and cabbage, a food slicing machine is provided formed with a series of hoppers overlying rotating blades. However, when attempting to slice foods of smaller cross-sectional areas, such as green peppers and the like as compared to lettuce heads for example, the feed hoppers are of a diameter to effect undesirable slicing due to the diminished cross-sectional area relative to the feed hopper cross-sectional area. In this vein, the instant invention attempts to provide an adapter to effectively direct food in a desired orientation relative to the rotating blades. Examples of the prior art include U.S. Pat. No. 3,799,023 to Bringard, et al., illustrating a rotary blade cutting arrangement relative to food hoppers utilized in a conventional vegetable cutting arrangement.

U.S. Pat. No. 4,040,319 to Taniyama sets forth a vegetable cutter arrangement utilizing a grid pattern of slicers with an overlying pivoted member to direct foods past the slicer blades.

U.S. Pat. No. 4,578,388 to Sullivan, et al., sets forth a pizza dough perforating device wherein a dough member is directed past cooperating rotating blades.

U.S. Pat. No. 4,643,084 to Gomez sets forth a cookie machine formed with forming and cutting apparatus for the creation of cookie arrangements.

U.S. Pat. No. 4,656,904 to Rayment provides a food cutter wherein strips are cut by means of reciprocating blades mounted orthogonally relative to potato portions being directed relative to the blades.

As such, it may be appreciated that there is a continuing need for a new and improved food slicer adapter arrangement to enable orientation and preslicing of various vegetables, such as peppers, of diminished cross-sectional area relative to larger cross-sectional area vegetables, such as cabbage and lettuce heads, within a vegetable cutting arrangement.

SUMMARY OF THE INVENTION

In view of the foregoing disadvantages inherent in the known types of vegetable cutters now present in the prior art, the present invention provides a food slicer adapter wherein the same enables preslicing and proper orientation of vegetables of a diminished cross-sectional area relative to larger cross-sectional area vegetables to an underlying cutting arrangement. As such, the general purpose of the present invention, which will be described subsequently in greater detail, is to provide a new and improved food slicer adapter which has all the advantages of the prior art food slicers and none of the disadvantages.

To attain this, the present invention comprises a tubular feed tube formed with an arcuate sector opening defining an opening less than 180 degrees of arc about an upper end of the tube. A transparent shield is positioned underlying the opening and overlies a plurality of diametrically opposed positioning flanges that are formed with slots or interfitting with slots formed within one of the feed hoppers of the slicing machine. A third alignment tab is utilized to properly stabilize the feed tube within the feed hopper. Orthogonally crossed cutting blades are positioned at a lowermost terminal end of the feed tube to preslice vegetables prior to their being directed relative to slicing blades of the cutting machine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved food slicer adapter which has all the advantages of the prior art food slicers and none of the disadvantages.

It is another object of the present invention to provide a new and improved food slicer adapter which may be easily and efficiently manufactured and marketed.

It is a further object of the present invention to provide a new and improved food slicer adapter which is of a durable and reliable construction.

An even further object of the present invention is to provide a new and improved food slicer adapter which is susceptible of a low cost of manufacture with regard to both materials and labor, and which accordingly is then susceptible of low prices of sale to the consuming public, thereby making such food slicer adapters economically available to the buying public.

Still yet another object of the present invention is to provide a new and improved food slicer adapter which provides in the apparatuses and methods of the prior art some of the advantages thereof, while simultaneously overcoming some of the disadvantages normally associated therewith.

Still another object of the present invention is to provide a new and improved food slicer adapter wherein the same effectively diminishes a cross-sectional area of a feed tube relative to underlying rotating cutters of a food slicing machine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1*a* is a diagrammatic top plan view of the instant invention positioned within a cutting machine.

FIG. 4 is a bottom plan view of the adapter of the instant invention.

DESCRIPTION OF THE PREFERRED EMBODIMENT

Figure 1:
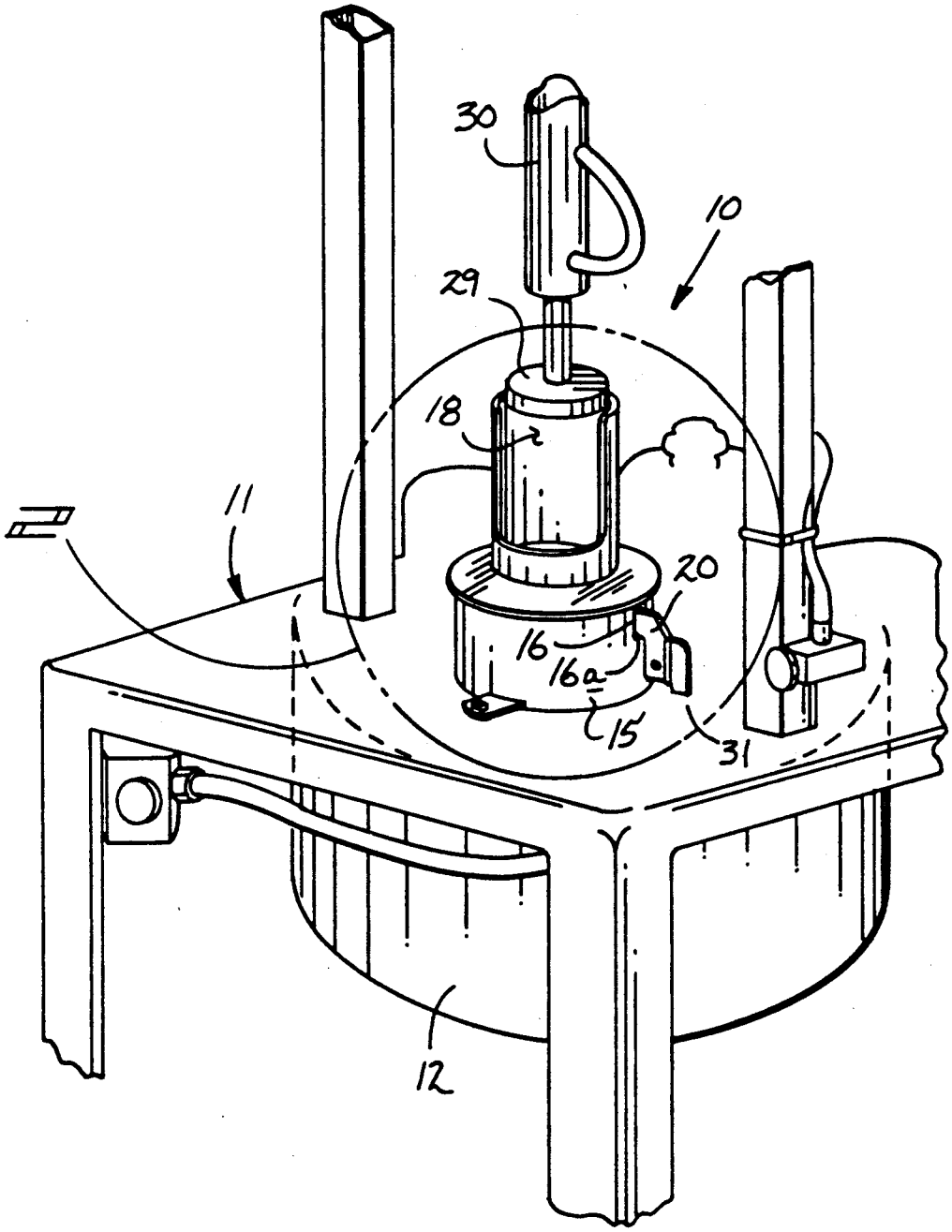
FIG. 1 is an isometric illustration of the instant invention.
Figure 2:
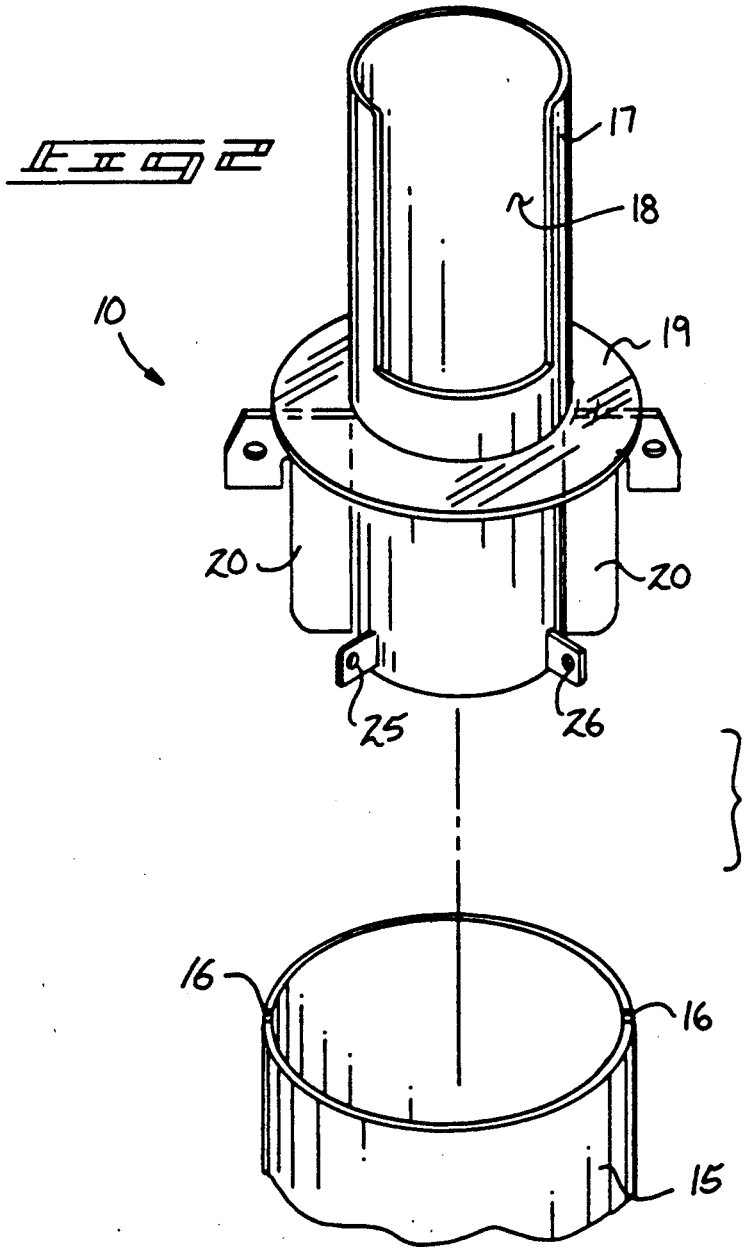
FIG. 2 is an isometric illustration of the adapter and its orientation relative to a feed hopper of the slicing machine.

With reference now to the drawings, and in particular to FIGS. 1 to 4 thereof, a new and improved food slicer adapter embodying the principles and concepts of the present invention and generally designated by the reference numeral 10 will be described.

More specifically, the food slicer adapter 10 of the instant invention is utilized in combination with the slicing machine 11 including an underlying slicing drum 12 positioned beneath a support table and fed by a series of feed hoppers 15 overlying a centrally rotating support 14 with a plurality of opposed cutting blades 13 mounted thereon. The adapter 10 is received within a plurality of diametrically opposed slots 16 of a predetermined height formed with a slot floor 16*a* defining a bottommost extent of the slot 16 to form a predetermined length. The adapter 10 is formed with an axially aligned cylindrical feed tube 17 formed with an arcuate sector feed opening 18, wherein the sector is defined by an arc of less than 180 degrees and of a height equal to or less than one-half the axial length of the feed tube 17. A transparent shield 19 of an angular configuration is integrally secured exteriorly of the feed tube 17, wherein the transparent shield is of a diameter greater than the diameter defined by the hopper 15 to form an abutment as the adapter 10 is positioned within the feed hopper 15. A plurality of diametrically opposed spacer flanges 20 are positioned coextensively and diametrically opposed to one another in an integral relationship on an exterior surface of the feed tube 17 between the transparent shield 19 and a lowermost end of the feed tube. The width of the flanges plus the external diameter of the feed 17 is substantially equal to the internal diameter of the feed hopper 15 to align and position the feed tube 17 coaxially relative to the feed hopper 15 with an alignment flange 21 positioned at approximately 90 degrees between the spacer flanges 20 to stabilize, as well as position, the feed tube 17 within the feed hopper 15. Each of the spacer flanges 20 are formed with leg members 22 extending coextensively outwardly of the flanges defining a leg slot 23 and an interconnecting web 24 defining the securement of the leg member 22 to a respective spacer flange 20. The connecting web is of a length substantially equal to the predetermined length of the slots 16 to position the adapter 10 and enable the feed tube 17 to be oriented coaxially of the feed hopper 15 with the shield 19 in abutment over an upper edge of the feed hopper 15. Securement apertures 22*a* formed through the leg member 22 receive fasteners to secure the leg members 22 to opposed securement webs 31 fixedly mounted relative to an upper surface of the slicer 11 and thereby integrally secure the adapter 10 relative to the slicer 11 in use.

Figure 3:
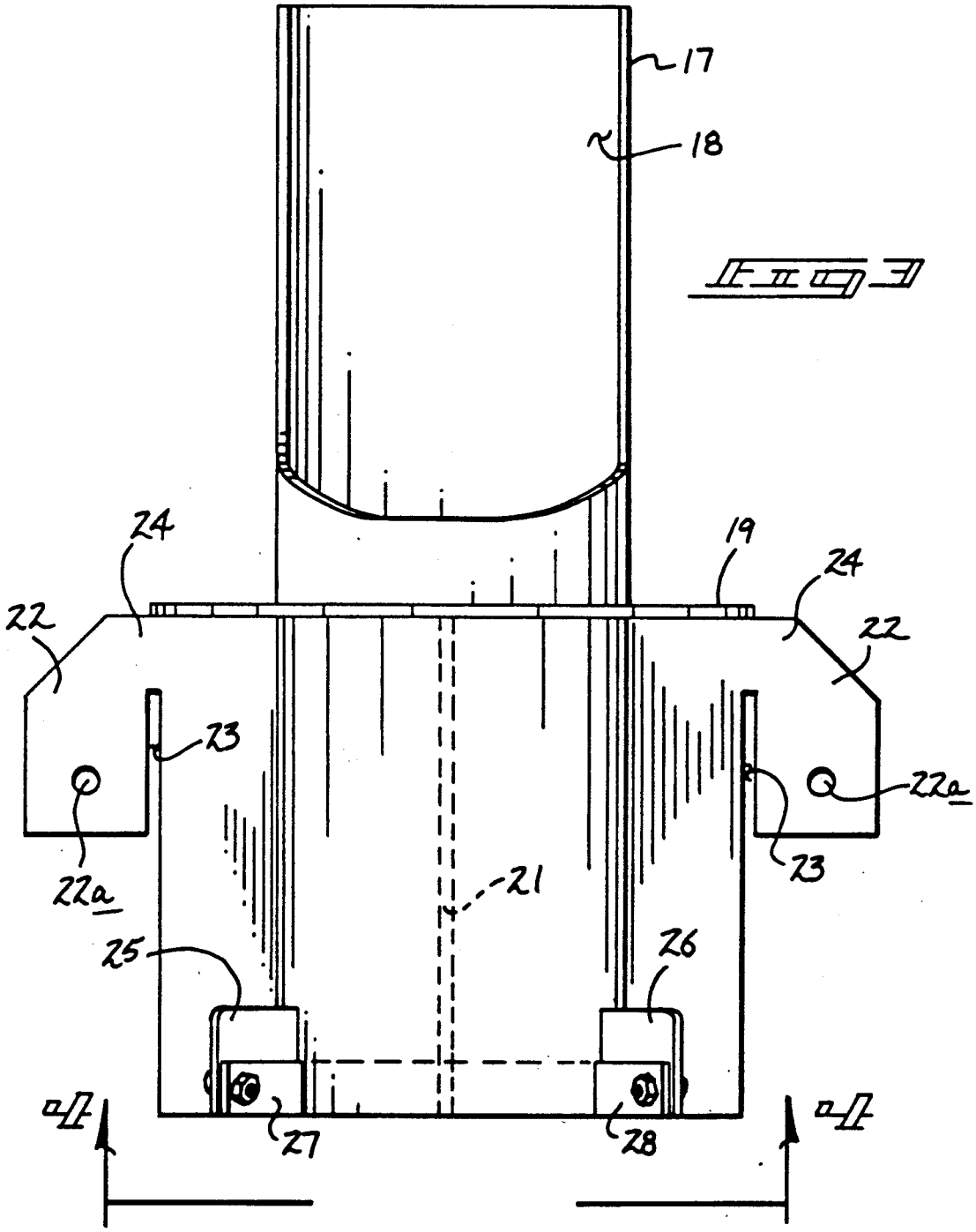
FIG. 3 is an orthographic view taken in elevation of the adapter of the instant invention.

With reference to the FIGS. 3 and 4 in particular, it should be noted that a first pair of blade anchor tabs 25 are orthogonally affixed adjacent a bottom edge of the feed tube 17 adjacent first blade slots 25*a* with a second pair of blade anchor tabs 26 positioned adjacent second blade slots 26*a* with the blade slots and anchor tabs diametrically opposed to one another and with the first pair of blade anchor tabs orthogonally aligned or displaced 90 degrees relative to the second pair of blade anchor tabs 26. Accordingly, a first blade 27 is secured to the first pair of anchor tabs 25 with a second blade 28 secured to the second pair of blade anchor tabs 26. In use, a plunger head 29 within an internal diameter substantially equal to the feed hopper 15 is reciprocatably mounted relative to a hydraulic cylinder 30 to direct food positioned within the feed tube 17 through the arcuate sector feed opening 18 past the crossed first and second blades 27 and 28 to preslice a vegetable quantity and direct such presliced vegetables interiorly of the slicing drum 12 to enable final slicing of the vegetable by the cutting blades 13 rotatably directed underlying the hopper 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A food slicer adapter in combination with a slicing apparatus, the slicing apparatus including a slicing drum with rotary blades mounted therewithin, and a plurality of cylindrical feed hoppers of a first diameter mounted externally of and in communication with the rotating blades, at least one of the feed hoppers including a plurality of diametrically opposed slots of a predetermined length coaxially aligned with the at least one feed hopper wherein the slots are formed in communication with an upper edge of the at least one feed hopper, and the adapter defined by an elongate tube of a second diameter less than that defined by the first diameter, including mounting means to coaxially align and affix the adapter to the at least one feed hopper in cooperation with the slots, and wherein the mounted means include a plurality of diametrically opposed spacer flanges, the spacer flanges defined by elongate edges defining a third diameter, wherein the third diameter is substantially equal to the first diameter, and wherein the spacer flanges each further include a leg member in alignment and positioned exteriorly of the spacer flanges and connected to the spacer flanges by a connecting web, each leg member defining a leg slot between the leg member and the spacer flange wherein the leg slot is substantially equal to the predetermined length of the slots.

2. A food slicer adapter as set forth in claim 1 further including a transparent shield overlying the spacer flanges wherein the shield is defined by a fourth diameter greater than the first diameter.

3. A food slicer adapter as set forth in claim 2 further including a plurality of fixed blades defined by a first fixed blade and a second fixed blade wherein the first fixed blade is orthogonally aligned relative to the second fixed blade and the fixed blades are mounted to the elongate tube adjacent a lowermost edge thereof.

4. A food slicer adapter as set forth in claim 3 including a first pair of diametrically opposed blade anchor tabs oriented at 90 degrees relative to a second pair of blade anchor tabs, the first blade anchor tabs securing the first blade thereto and the second pair of anchor tabs securing the second blade thereto.

5. A food slicer adapter as set forth in claim 4 wherein each leg member further includes an aperture, wherein the aperture receives a fastener to secure the adapter relative to a securement web, each securement web integrally secured to the slicing apparatus to fixedly mount the adapter relative to the slicing apparatus.

6. A food slicer adapter as set forth in claim 5 further including an arcuate feed opening formed above the shield wherein the feed opening is formed through a wall of the elongate tube and is defined by an arc of less than 180 degrees.

7. A food slicer adapter as set forth in claim 6 further including a plunger defined by an external diameter substantially equal to an internal diameter defined by the feed tube, wherein the plunger face is reciprocatably mounted within the feed tube and is mounted to a hydraulic cylinder to selectively direct vegetable workpieces past the first and second blades to initially slice the vegetable workpieces prior to directing the vegetable workpieces to the rotating blades.

8. A food slicer adapter as set forth in claim 7 further including an alignment flange positioned 90 degrees offset relative to each of the spacer flanges and defined by a width substantially equal to the width defined by each spacer flange.

* * * * *